US007594795B2

(12) United States Patent
Kriz et al.

(10) Patent No.: US 7,594,795 B2
(45) Date of Patent: Sep. 29, 2009

(54) STEAM TURBINE

(75) Inventors: Davor Kriz, Baden (CH); Philip John Peel, Hornussen (CH)

(73) Assignee: Alstom Technology Ltd, Baden (CH)

( * ) Notice: Subject to any disclaimer, the term of this patent is extended or adjusted under 35 U.S.C. 154(b) by 497 days.

(21) Appl. No.: 11/451,419

(22) Filed: Jun. 13, 2006

(65) Prior Publication Data

US 2006/0292003 A1 Dec. 28, 2006

(30) Foreign Application Priority Data

Jun. 14, 2005 (CH) ..... 01012/05

(51) Int. Cl.
*F01D 25/28* (2006.01)

(52) U.S. Cl. ..... 415/213.1

(58) Field of Classification Search ..... 415/103, 415/209.2

See application file for complete search history.

(56) References Cited

U.S. PATENT DOCUMENTS

| | | | | |
|---|---|---|---|---|
| 2,854,212 | A * | 9/1958 | Lantermann | 415/209.2 |
| 3,206,166 | A * | 9/1965 | Beldecos et al. | 415/93 |
| 4,699,566 | A * | 10/1987 | Miller | 415/209.2 |
| 4,863,341 | A | 9/1989 | Groenendaal | |
| 2004/0071544 | A1 * | 4/2004 | Vogan et al. | 415/103 |

FOREIGN PATENT DOCUMENTS

| | | | |
|---|---|---|---|
| GB | 773430 | * | 4/1957 |

* cited by examiner

*Primary Examiner*—Richard Edgar
(74) *Attorney, Agent, or Firm*—Buchanan Ingersoll & Rooney PC

(57) ABSTRACT

The invention relates to a steam turbine, in particular for a power plant, comprising an outer casing, an inner casing arranged in the outer casing, and a plurality of guide blade rows. In order to reduce leakage flows in the inner casing, a blade ring is provided, which is arranged in the inner casing and in which at least some of the guide blade rows are arranged.

10 Claims, 8 Drawing Sheets

STEAM TURBINE

RELATED APPLICATION

The present application claims priority under 35 USC § 119 to Swedish Patent Application No. 01012/05. filed Jun. 14, 2005, the contents of which are hereby incorporated by reference in their entirety.

TECHNICAL FIELD

The invention relates to a steam turbine, in particular for a power plant.

PRIOR ART

The steam turbine conventionally has an outer casing and an inner casing arranged therein. A plurality of guide blade rows are arranged axially one behind the other in the inner casing and consist in each case of a plurality of guide blades arranged next to one another in a circumferential direction.

For a high efficiency of the steam turbine, it is of critical importance to avoid leakage flows which bypass the guide blades of the blade tips. Effective sealing off of the regions of the blade tips is often made difficult due to the fact that the inner casing experiences asymmetric deformation when the steam turbine is in operation. Deformations of the inner casing are attributable to the high pressures and to the high thermal loads. Asymmetric deformations of the inner casing arise particularly when the inner casing consists of two inner casing halves which are fastened to one another along a midplane via external lateral flanges. The inner casing necessarily possesses a different flexion behavior in the region of the flanges from that between the flanges. The original circular cross section of the inner casing may be deformed due to the compressive load occurring during operation, for example elliptically or ovally or due to a contraction in the region of the flanges, which may lead locally to an enlargement of the radial clearance of the blade tips. Undesirable leakages may occur correspondingly there. Two-part inner casings are used in order to simplify the mounting and demounting of the steam turbine.

In order to reduce the asymmetric deformation of the inner casing, it is basically possible to fasten the two inner casing halves to one another not via laterally projecting flanges, but via tension rings which are drawn from outside onto the inner casing halves lying one on the other. However, the outlay required for this purpose is relatively high. In particular, the subsequent removal of the tension rings is sometimes difficult.

PRESENTATION OF THE INVENTION

The invention is intended to remedy this. The invention, as characterized in the claims, is concerned with the problem of specifying for a steam turbine of the type initially mentioned an improved embodiment which is distinguished particularly by reduced leakage.

This problem is solved, according to the invention, by means of the subject matter of the independent claim. Advantageous embodiments are the subject matter of the dependent claims.

The invention is based on the general idea of arranging at least some of the guide blade rows in a blade ring which is itself arranged in the inner casing. A blade ring of this type can be sealed off efficiently with respect to the inner casing in a relatively simple way.

Furthermore, the blade ring is not exposed to the overall compressive load of the steam turbine when it does not have all the guide blade rows, but only some of these. The forces arising at the blade ring are correspondingly comparatively low. The lower these forces arising are, the more simply a symmetrical deformation of the blade ring can be achieved. However, a symmetric deformation leads to no or to only slight leakage flows. In the steam turbine according to the invention, the inner casing is decoupled from those deformation forces which arise in the region of the guide blade rows arranged in the blade ring. A deformation of the inner casing is to that extent already reduced. In the region of the blade ring, the inner casing serves mainly for the axial support of the axial forces acting on the guide blade rows of the blade ring. The moments acting on the blade ring in the circumferential direction can also be absorbed by the inner casing.

Preferably, the blade ring is fixed axially to the inner casing in an axial fixing and is otherwise freely movable axially in relation to the inner casing. The blade ring is thereby decoupled kinematically from the inner casing, but can absorb the axial forces acting on the blade ring via the guide blades arranged therein.

A development is particularly advantageous in which the axial fixing is configured, moreover, as a seal which prevents or at least impedes a flow around the blade ring. For this purpose, fixing between the blade ring and inner casing has a contact zone which runs completely around annularly and which, in particular, allows radial movement between the blade ring and inner casing. A particularly effective seal between the inner casing and the blade ring can thereby be implemented in a structurally simple and therefore cost-effective way.

Further important features and advantages of the steam turbine according to the invention may be gathered from the subclaims, from the drawings and from the accompanying figure description with reference to the drawings.

BRIEF DESCRIPTION OF THE DRAWINGS

Preferred exemplary embodiments of the invention are illustrated in the drawings and are explained in more detail in the following description, identical reference symbols referring to identical or similar or functional identical components. In the drawings, in each case diagrammatically.

WAYS OF IMPLEMENTING THE INVENTION

Figure 1:
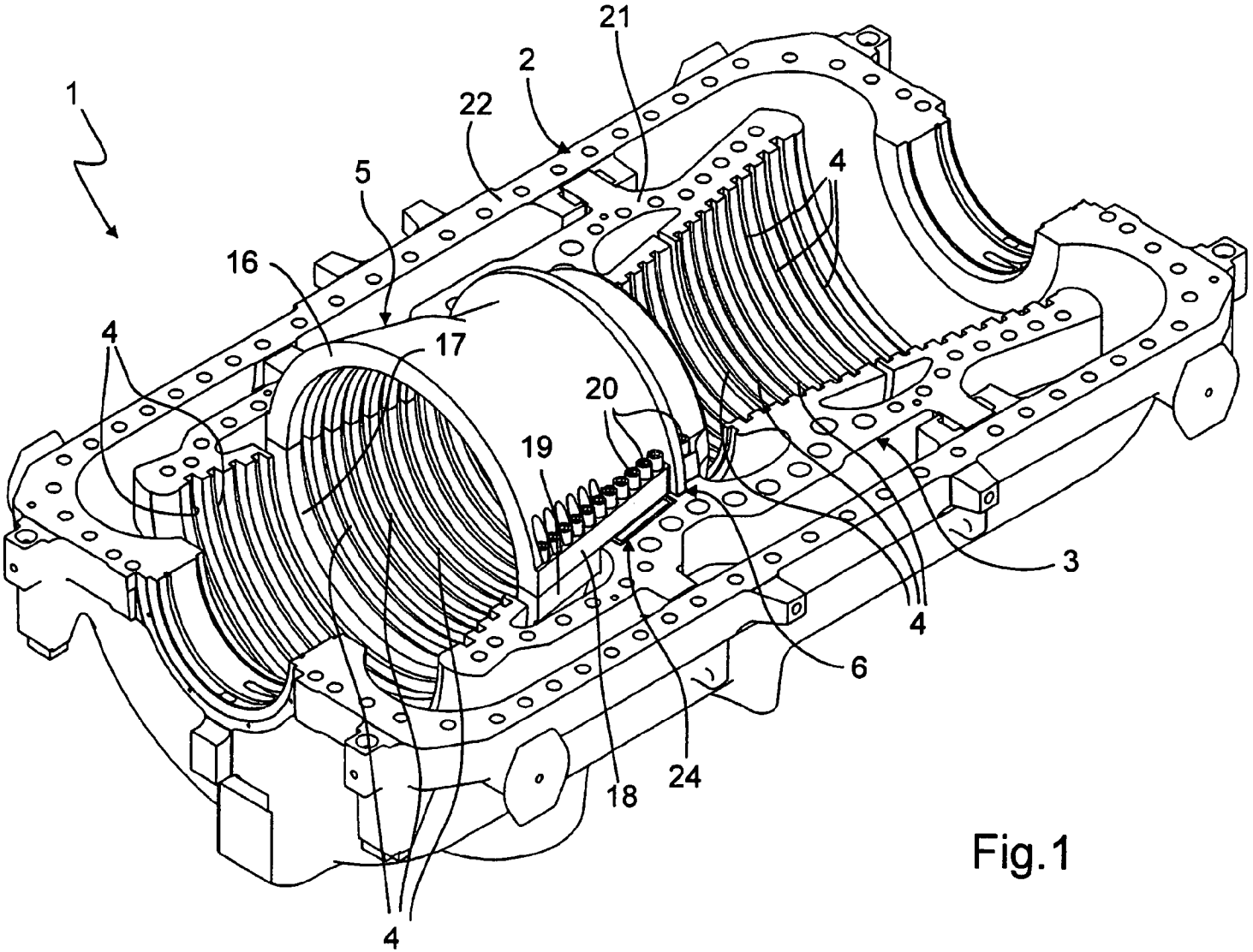
FIG. 1 shows a perspective part view of the steam turbine according to the invention.

According to FIG. 1, a steam turbine 1 according to the invention, which is employed preferably in a power plant, preferably as the medium-pressure turbine or high-pressure turbine, comprises an outer casing 2 in which an inner casing 3 is arranged. A steam turbine 1 of this type comprises, furthermore, a multiplicity of guide blade rows, which, however, are not illustrated here.

What are shown, however, are guide blade receptacles 4, into which guide blades or guide blade carriers can be inserted individually or in groups. The guide blade rows, not shown, are thus represented here by the guide blade receptacles and are also designated below by 4. The individual guide blade rows 4 are arranged one behind the other in the axial direction of the steam turbine 1. The individual guide blades are arranged next to one another in the circumferential direction in the respective guide blade row 4.

Moreover, the steam turbine 1 conventionally has a rotor, not shown here, which carries a corresponding number of moving blade rows.

The steam turbine 1 according to the invention is distinguished in that it is equipped with at least one blade ring 5 which carries some of the guide blade rows 4. The blade ring 5 is in this case arranged in the inner casing 3, and the guide blade rows 4 assigned to the blade ring 5 are arranged in the blade ring 5.

Figure 2:
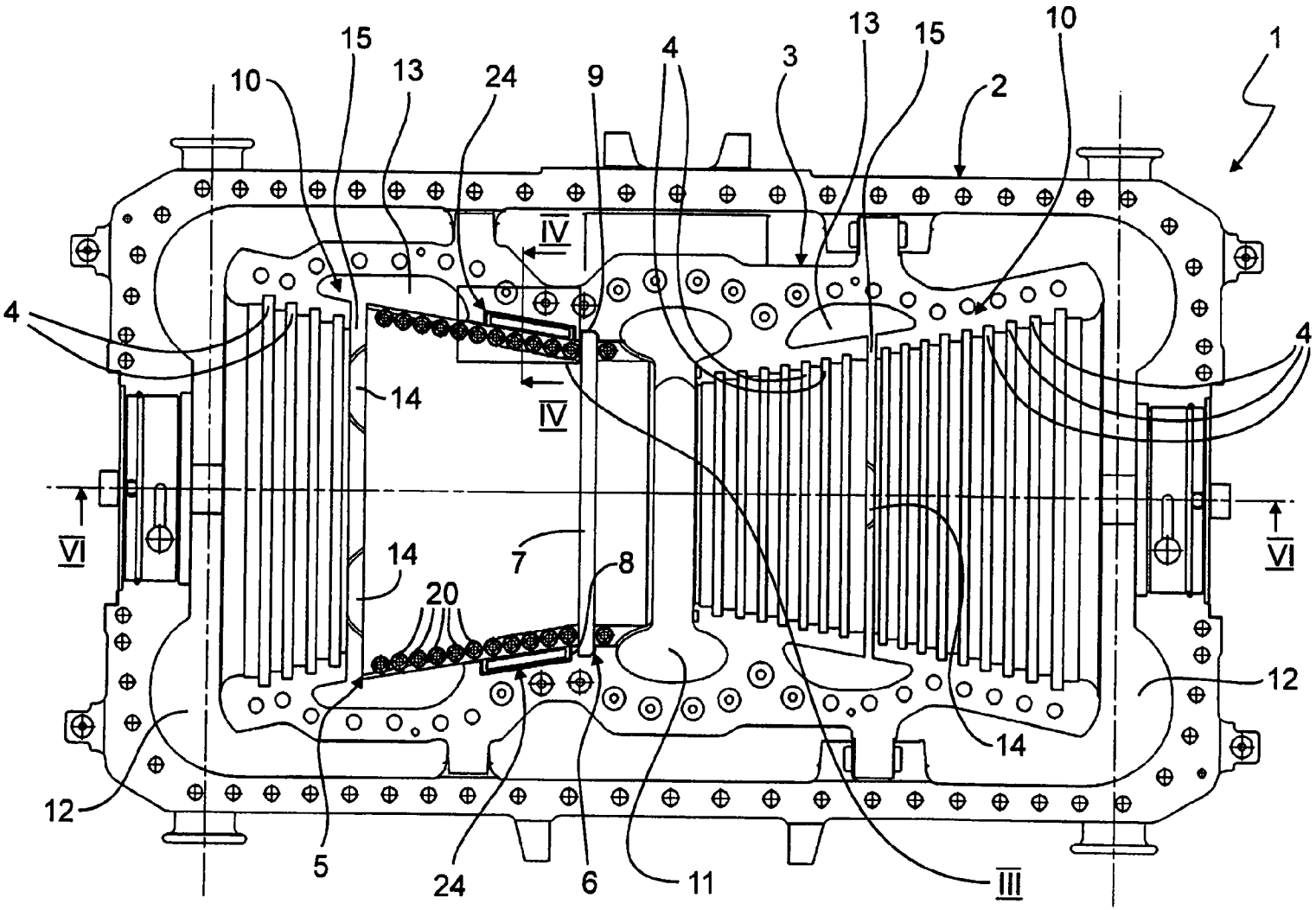
FIG. 2 shows a top view of the steam turbine from FIG. 1.

According to FIGS. 1 and 2, said blade ring 5 is fixed axially to the inner casing 3 with the aid of exactly one axial fixing 6. Otherwise, that is to say outside the fixing 6, the blade ring 5 is axially loose or freely movable in relation to the inner casing 3. The fixing 6 is in this case arranged near an inflow-side end of the blade ring 5. In the preferred embodiment shown here, the fixing 6 is formed by a collar 7 which projects radially outward from the blade ring 5 and runs around annularly on the latter. Furthermore, the collar 7 is supported axially on the supporting surface 8 which is formed on the inner casing 3. This supporting surface 8 is formed here by an annular groove 9 which is made in the inner casing 3 and into which the collar 7 engages radially. The collar 7 and supporting surface 8 are expediently designed such that the fixing 6 additionally acts as a seal. The supporting surface 8 is then a sealing surface which is also designated below by 8. This is achieved, for example, by means of a contact zone between the collar 7 and the supporting or sealing surface 8, said contact zone running around, closed, in the circumferential direction and, moreover, expediently extending in a plane which is perpendicular to the longitudinal axis of the steam turbine 1. The axial seal formed by the fixing 6 or in the fixing 6 prevents or impedes a flow around the blade ring 5.

In the exemplary embodiment shown here, the steam turbine 1 is designed as a double-flow steam turbine 1, each flow 10 constituting a turbine, and these being coupled to one another via the common rotor. The two turbines or flows 10 are designed asymmetrically here. In particular, only one of the two turbines or flows 10 is equipped with the blade ring 5. In principle, in another embodiment, each flow or turbine 10 could have such a blade ring 5. In another embodiment, the steam turbine 1 may also be designed as a single-flow steam turbine 1.

In the embodiment shown here, within the respective flow or turbine 10, some, in particular the plurality, of the guide blade rows 4 are arranged on the blade ring 5, while all the other guide blade rows 4 are arranged on the inner casing 3. It is notable in this case that the first guide blade row 4 is arranged on the blade ring 5 within this flow 10, while the last guide blade row 4 is arranged on the inner casing 3. In this case, the first guide blade row 4 is adjacent to an inflow space 11 which is arranged centrally between the two flows 10, while the last guide blade row is arranged adjacently to an outflow space 12 which is located essentially between the inner casing 3 and the outer casing 2. The inflow space 11 in this case forms a steam inlet into the turbine of the respective flow 10, while the outflow space 12 forms a steam outlet from this turbine.

Steam turbine 1 or the turbine of the respective flow 10 has an extraction pressure space 13 between the associated steam inlet or inflow space 11 and the associated steam outlet or outflow space 12. This extraction pressure space 13 is connected to at least one extraction line 14, with the aid of which extraction steam can be extracted from the steam turbine 1 or the turbine of the respective flow 10. Depending on the turbine stage to which the extraction pressure space 13 is connected, the extraction steam has a corresponding pressure level and/or a corresponding temperature level. In the left flow 10 shown in FIGS. 1, 2 and 6, the extraction pressure space 13 is arranged approximately in the last third of the turbine stages, that is to say the extraction pressure space 13 communicates with a turbine stage arranged in the last third. In contrast to this, in the flow 10 shown in each case on the right, the extraction pressure space 13 is arranged approximately in the middle of the turbine stages, that is to say the extraction pressure space 13 is connected to a turbine stage which is located approximately in the middle of the turbine stages. In this case, the respective extraction pressure space 13 communicates with the respectively assigned turbine stage via an extraction gap 15 which is arranged between two guide blade rows 4.

In the turbine or flow 10 equipped with the blade ring 5, the guide blade row 4 which is connected upstream to the extraction gap 15 is formed by the last guide blade row 4 of the blade ring 5. In contrast to this, the guide blade row 4 connecting downstream to the extraction gap 15 is already arranged on the inner casing 3. This is, in particular, the first guide blade row 4 of the inner casing 3.

This design is in this case particularly important since, in this way, the blade ring 5 does not incur the entire pressure difference, but only a large part of the pressure difference arising between the inflow space 11 and outflow space 12 of this turbine or flow 10. The pressure forces to be absorbed by the blade ring 5 are therefore lower than the overall pressure forces occurring, so the blade ring 5 may have a correspondingly small dimensioning. Consequently, in particular, design for the blade ring 5 may be selected which exhibits an approximately symmetrical deformation behavior.

As may be gathered particularly from FIG. 1, a two-part construction is preferred for the blade ring 5, so that the blade ring 5 is assembled from two blade ring halves 16, 17. The blade ring halves 16, 17 are in this case fastened to one another along an axial midplane. This midplane corresponds in FIG. 2 to the drawing plane. So that the two blade ring halves 16, 17 can be fastened to one another, external lateral flanges 18, 19, which are screwed to one another with the aid of screws 20, are formed on the blade ring halves 16, 17 on each side. Since the expected compressive loads on the blade ring 5 are comparatively low, the flanges 18, 19 can have a relatively compact build, so that they project only slightly beyond the blade ring halves 16, 17 in the radial direction. In particular, the flanges 18, 19 can thereby be configured such that a circumferentially essentially symmetrical deformation behavior is established for the blade ring 5. A symmetrical deformation is advantageous in terms of small gaps of the blade tips.

Preferably, the inner casing 3 is also assembled from two inner casing halves 21 which are fastened to one another on an axial midplane. Preferably, for this purpose, corresponding external lateral flanges, not designated in any more detail here, are provided, which make it possible to screw the two inner casing halves 21 together. The outer casing 2 expediently also consists of two outer casing halves 22 which are screwed to one another correspondingly via external lateral flanges, the outer casing halves 22 also bearing against one another in an axial midplane. The midplane of the inner casing halves 21 or of the outer casing halves 22 lies in the drawing plane of FIG. 2 and thus coincides with the midplane of the blade ring halves 16, 17. Such a two-part construction with casing halves 21, 22 and blade ring halves 16, 17 simplifies the mounting and demounting of the steam turbine 1.

Figure 3:
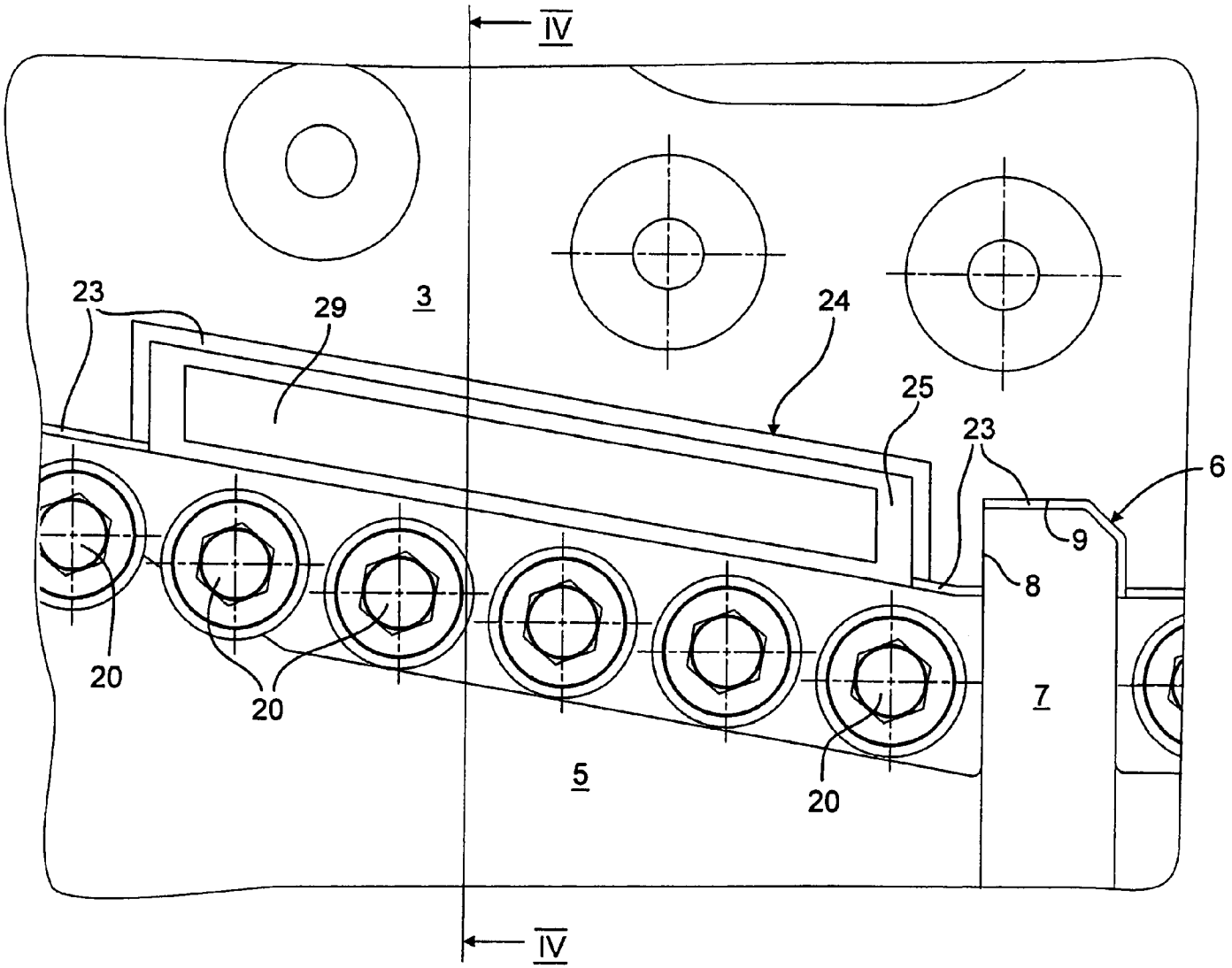
FIG. 3 shows an enlarged detail III from FIG. 2.
Figure 4:
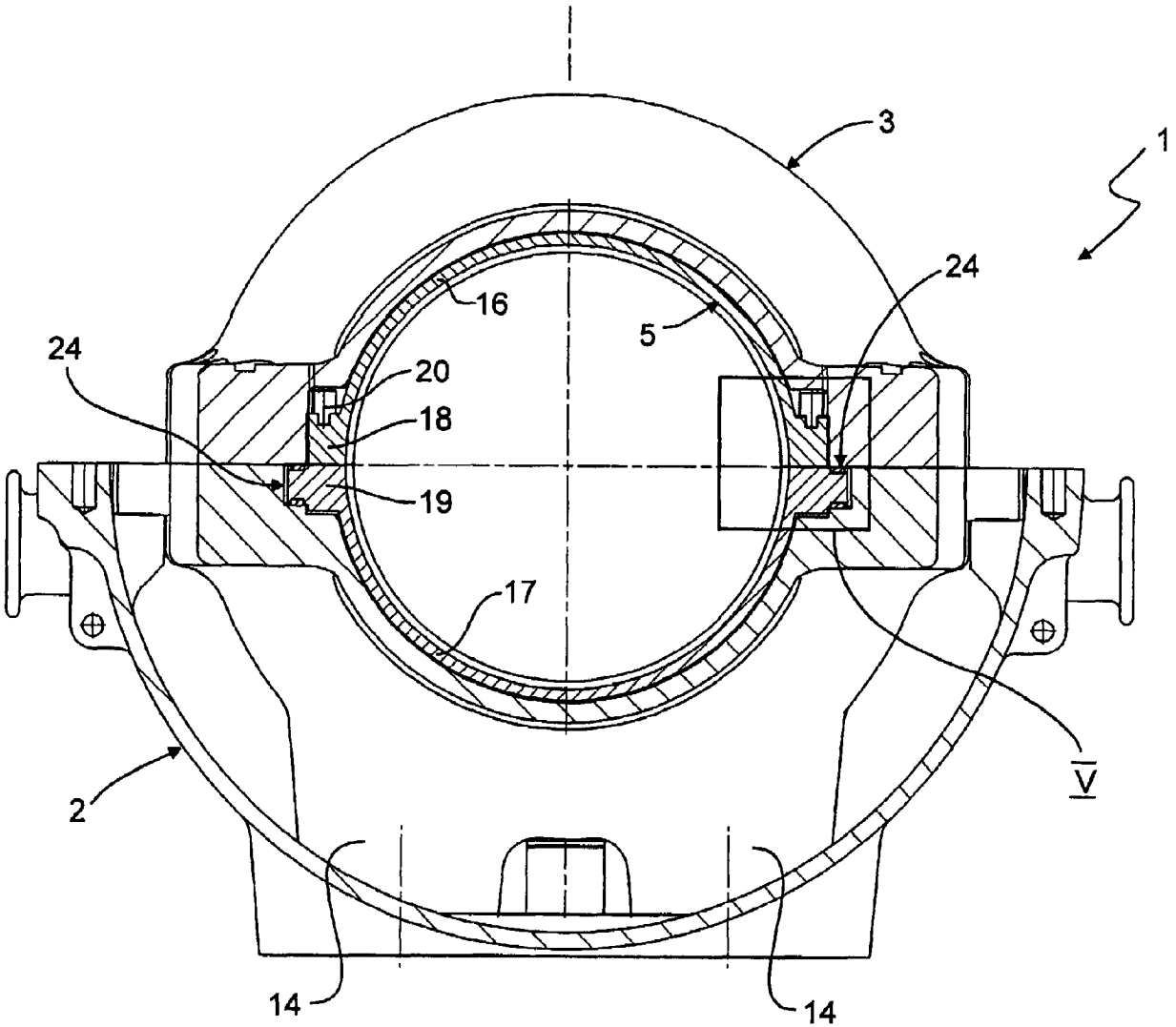
FIG. 4 shows a cross section corresponding to the sectional lines IV in FIG. 2 and FIG. 3.
Figure 5:
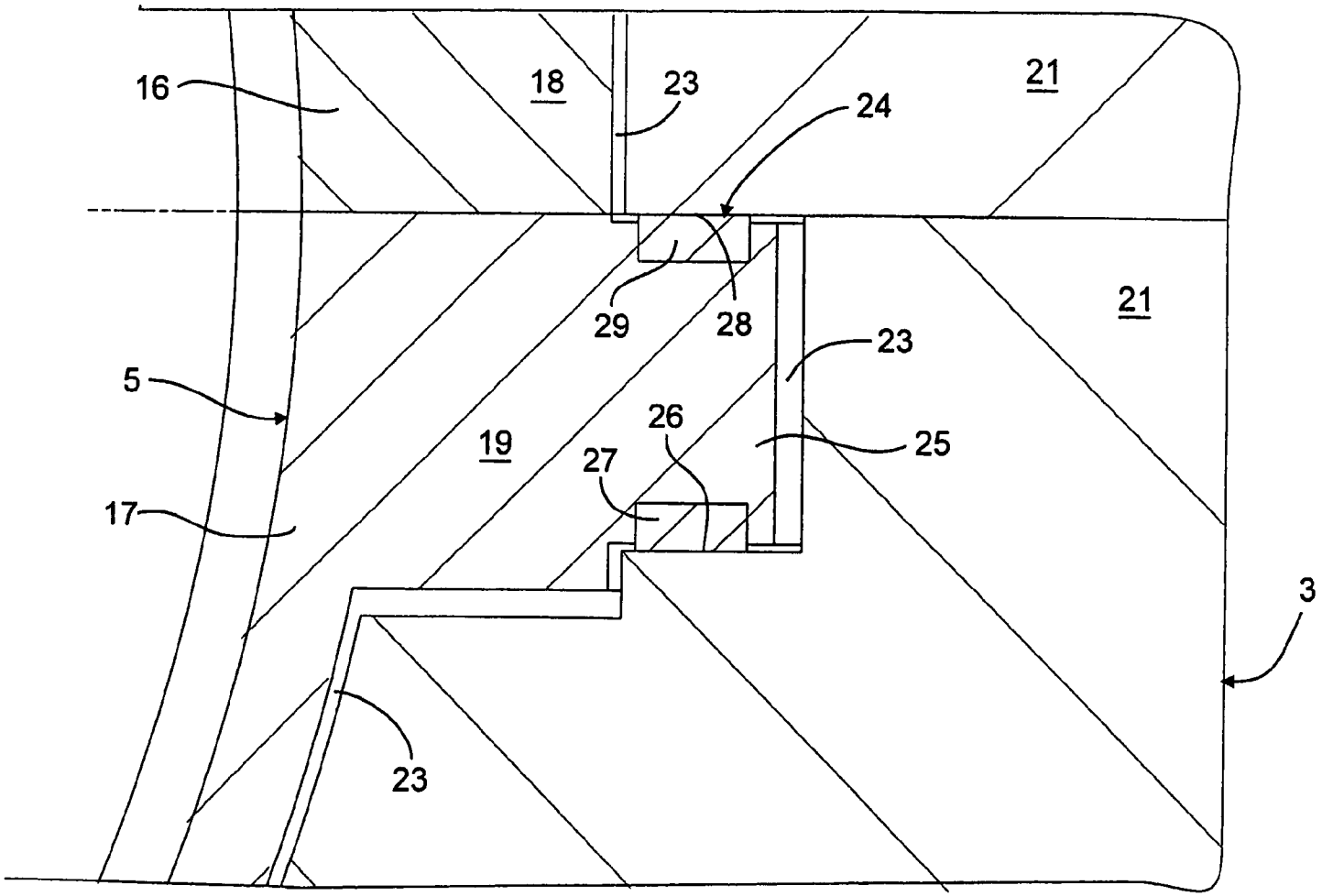
FIG. 5 shows an enlarged detail V from FIG. 4.
Figure 7:
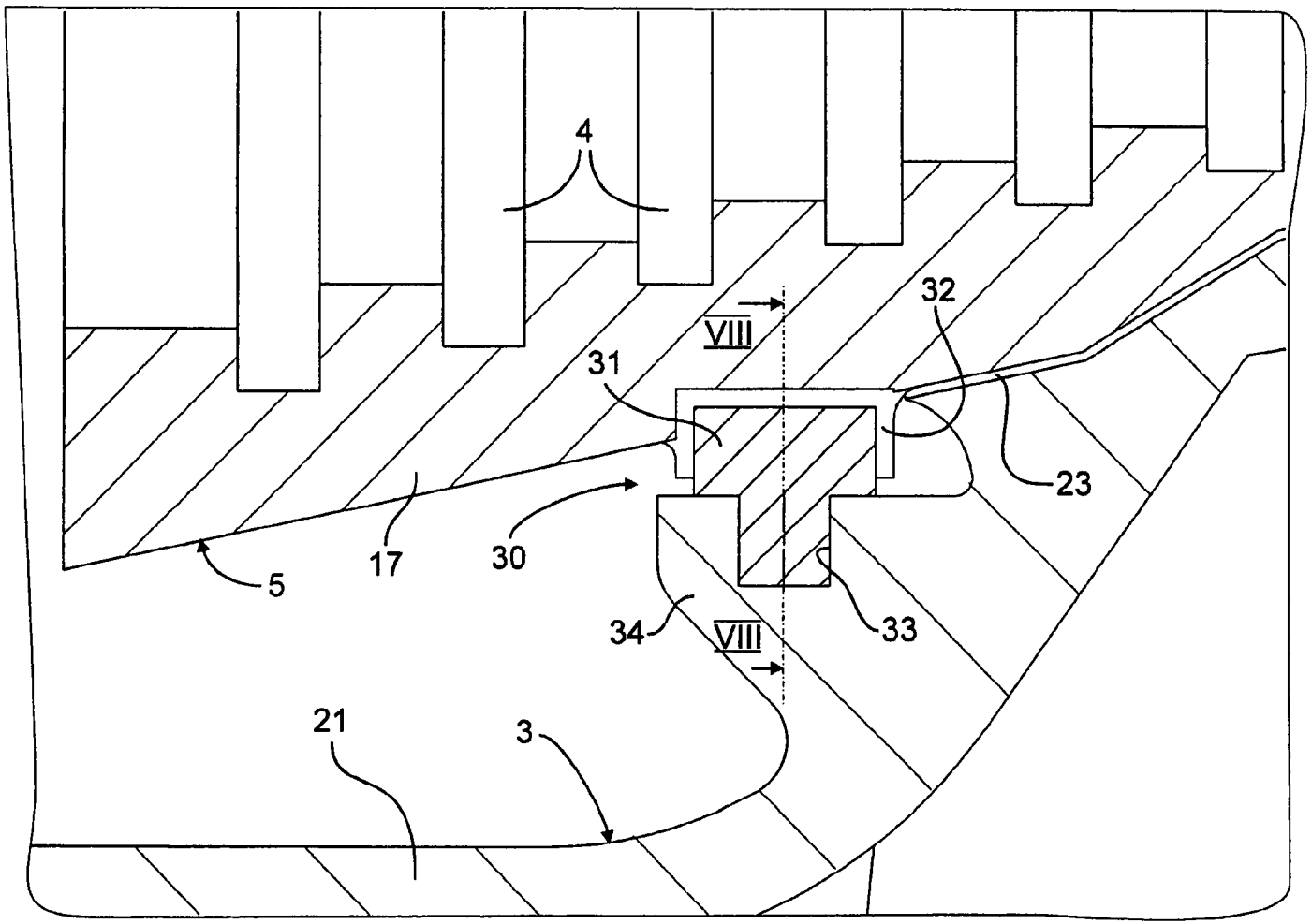
FIG. 7 shows an enlarged detail VII from FIG. 6.

As can be seen particularly clearly, for example, from the enlarged views of FIGS. 3, 5 and 7, the blade ring 5 is expediently arranged in the inner casing 3 with a radial clearance 23. This achieves a decoupling between the blade ring 5 and inner casing 3 in terms of a transmission of radial forces. In particular, therefore, a deformation of the blade ring 5 does not automatically lead to a deformation of the inner casing 3.

According to FIG. 2 to 5, the blade ring 5 is supported on the inner casing 3, in the vicinity of the fixing 6, via at least one axial vertical support 24. Preferably, two vertical supports 24 of this type are provided, which are arranged mirror-symmetrically on sides facing away from one another. The two vertical supports 24 are in this case configured such that they allow axial relative movements between the blade ring 5 and inner casing 3. For this purpose, the vertical supports 24 lie in a sliding bearing plane extending parallel to that midplane which at the same time forms the parting plane of the blade ring 5 and, in particular, of the two casings 2, 3. As may be gathered from FIGS. 2 and 4 and particularly clearly from FIGS. 3 and 5, each vertical support 24 comprises a carrier 25 which projects radially from the blade ring 5. In this case, the respective carrier 25 cooperates directly or indirectly with a carrying step 26 which is formed on the inner casing 3. The carrier 25 in this case expediently lies via a sliding plate 27 on the associated carrying step 26. In the mounted state, support takes place in the direction of gravity. The respective carrier 25 is expediently formed on the blade ring half 17 which is the lower in the mounted state, specifically preferably on the flange 19 of the latter. The carrying step 26 is also provided correspondingly on the inner casing half 21 which is the lower in the mounted state. To form the carrying step 26, the inner casing 3 has worked out in it a recess which is delimited downwardly by the carrying step 26 and upwardly by a guide step 28. The guide step 28 thus extends parallel to the carrying step 26. The carrier 25 is also supported on the guide step 28, specifically preferably again via a sliding plate 29. In this case, the guide step 28 is formed on the inner casing half 21 which is the upper in the mounted state. The contact zones between the individual components of the vertical support 24 expediently extend rectilinearly in the axial direction and preferably in axial planes which run parallel to the separating plane or midplane of the blade ring halves 16, 17 or of the inner casing halves 21.

The sliding plates 27, 29 are configured such that particularly low coefficients of friction arise. The blade ring 5 is mounted via the sliding plates 27, 29 on the carrying step 26 and on the guide step 28 movably in the axial direction and transversely thereto, that is to say perpendicularly to the direction of gravity. Furthermore, the vertical supports 24 absorb a large part of the weight of the blade ring 5. Moreover, the vertical supports 24 can, by means of the circumferential fixing of the blade ring 5, transmit to the inner casing 3 moments which are introduced into the blade ring 5 via the guide blades when the steam turbine 1 is in operation.

Figure 6:
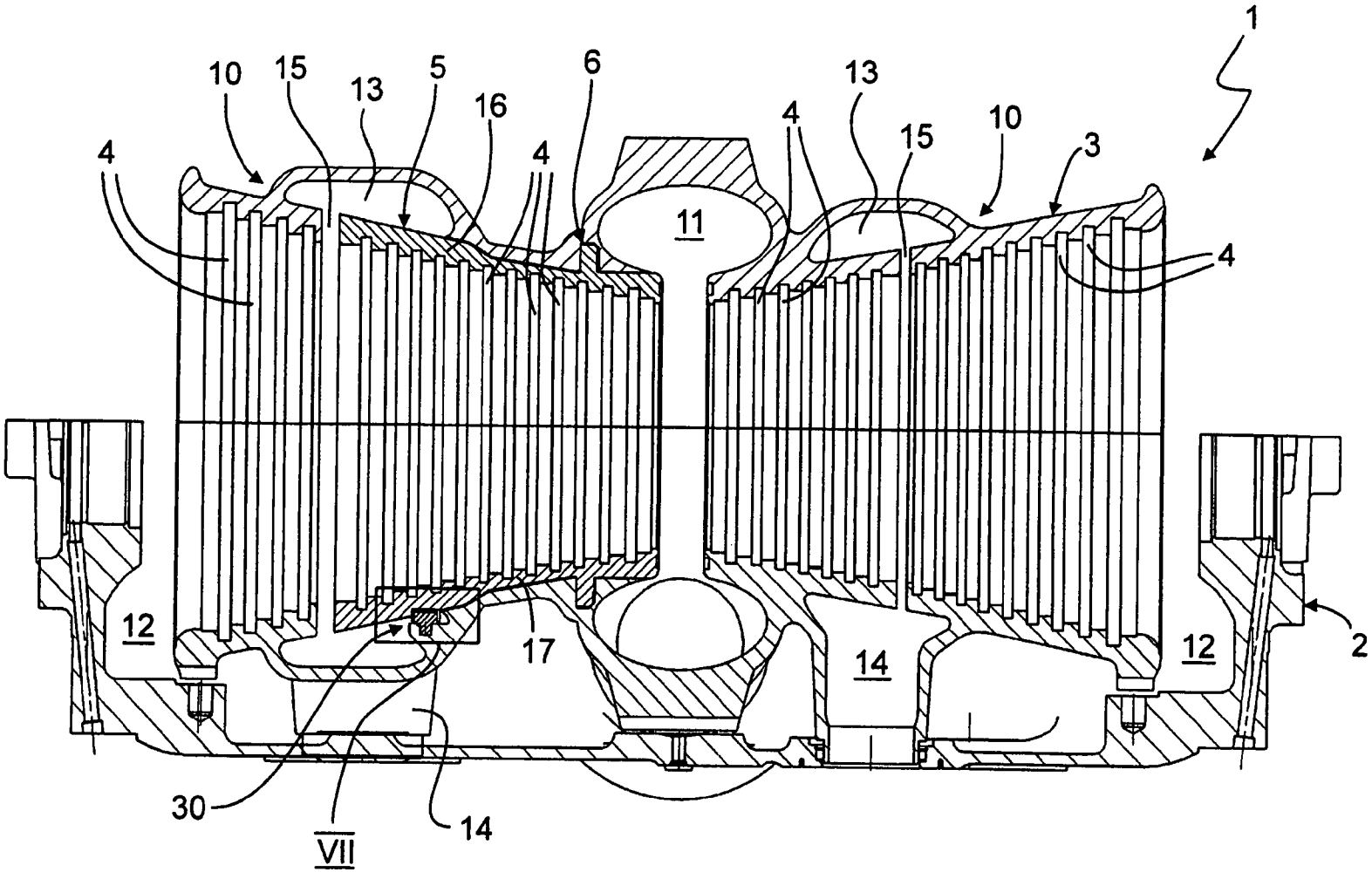
FIG. 6 shows a longitudinal section corresponding to the sectional lines VI in FIG. 2.
Figure 8:
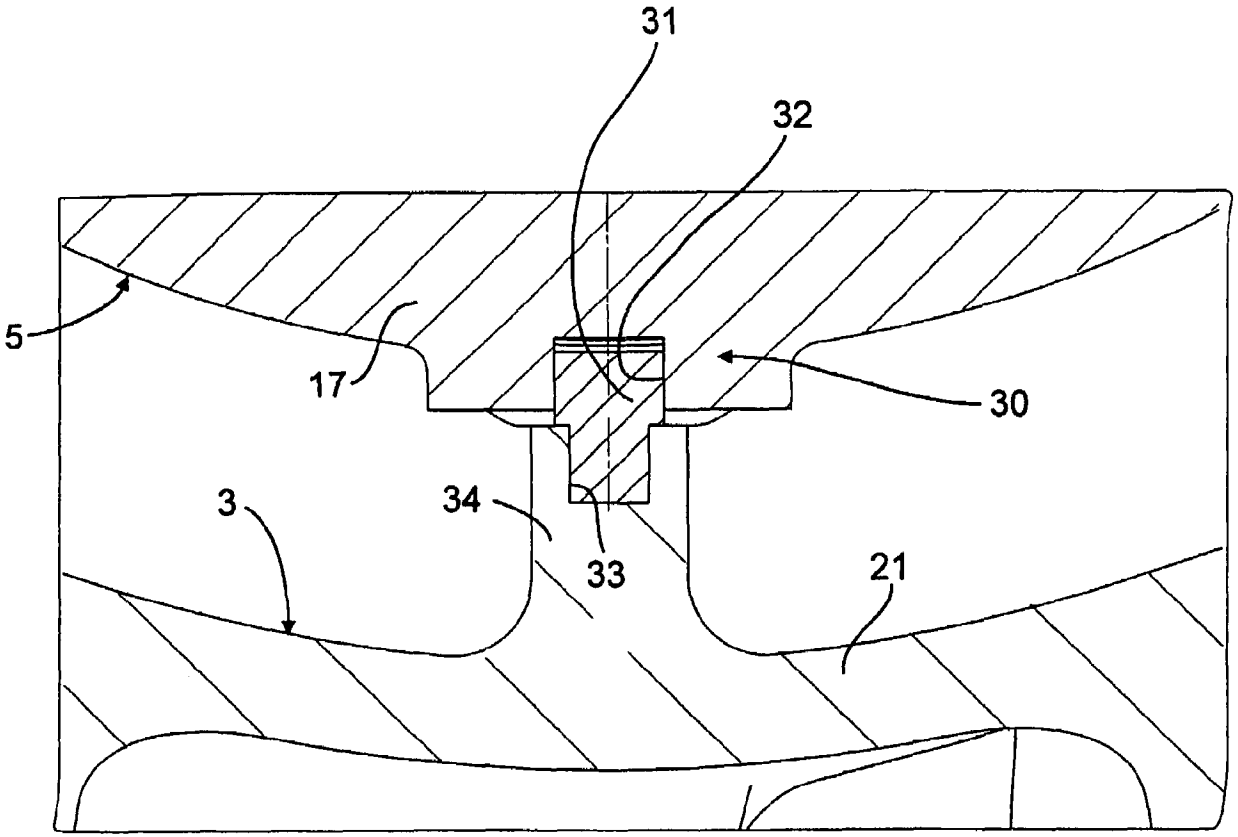
FIG. 8 shows a cross section corresponding to the sectional lines VIII in FIG. 7.

According to FIG. 6 to 8, the blade ring 5 is supported on the inner casing 3, specifically in the circumferential direction, by means of at least one axial guide 30 in the region of an axial portion which is remote from the fixing 6 and is spaced apart from the vertical supports 24. This axial guide 30 is in this case configured such that it fixes the blade ring 5 to the inner casing 3 in the circumferential direction, while at the same time it allows relative movements between the blade ring 5 and the inner casing 3 in the axial direction and preferably also in the radial direction. This is achieved, here, with the aid of a guide body 31 which, on the one hand, is arranged fixedly on the inner casing 3 and, on the other hand, engages radially into an axial groove 32 formed on the blade ring 5. The axial groove 32 has two opposite and axially extending walls on which the guide body 31 is supported in the circumferential direction. The blade ring 5 is fixed to the inner casing 3 fixedly in terms of rotation via this axial groove 32 and the guide body 31, but is otherwise freely movable in the axial direction and radially in relation to the inner casing 3. In particular, the blade ring 5 is not supported axially or radially on the inner casing 3 at any point in the region of the axial guide 30.

The guide body 31 is a separate component with respect to the inner casing 3. The guide body 31 is inserted into a guide body holder 33 which is formed on the inner casing 3. The guide body 31 may, in principle, be anchored firmly in the guide body holder 33; a rotatable mounting is likewise possible. The inner casing 3 is provided in the region of the axial guide 30 with an extension 34 which projects toward the blade ring 5 from adjacent regions of the inner casing 3. The guide body 31 shown here is arranged on that inner casing half 21 which lies at the bottom in the mounted state. The axial groove 32 is also formed correspondingly on the blade ring half 17 which is the lower in the mounted state. The axial guide 30 explained here in more detail is in this case located centrally between the flanges 18, 19 or centrally between the vertical supports 24. Although only a single axial guide 30 is shown here, a plurality of such axial guides 30 may, in principle, be arranged so as to be distributed in the circumferential direction.

The blade ring 5 is thus arranged in the inner casing 3 in that the two vertical supports 24 absorb the entire weight forces and moments and at the same time allow relative movements in a horizontal plane, and/or in that the fixing 6 absorbs the entire axial forces, and/or in that the axial guide 30 absorbs moments and at the same time allows relative movements in an axial vertical plane, and/or in that the blade ring 5, with the exception of the fixing 6, of the vertical supports 24 and of the axial guide 30, is arranged contactlessly in the inner casing 3.

LIST OF REFERENCE SYMBOLS

1 Steam turbine
2 Outer casing
3 Inner casing
4 Guide blade receptacle/guide blade row
5 Blade ring
6 Axial fixing
7 Collar
8 Supporting surface/sealing surface
9 Annular groove
10 Flow/turbine
11 Inflow space
12 Outflow space
13 Extraction pressure space
14 Extraction line
15 Extraction gap
16 Blade ring half
17 Blade ring half
18 Flange
19 Flange
20 Screw
21 Inner casing half
22 Outer casing half

23 Radial clearance
24 Vertical support
25 Carrier
26 Carrying step
27 Sliding plate
28 Guide step
29 Sliding plate
30 Axial guide
31 Guide body
32 Axial groove
33 Guide body holder
34 Extension

The invention claimed is:

1. A steam turbine, comprising:

an outer casing;

an inner casing arranged in the outer casing;

a plurality of guide blade rows;

at least one blade ring arranged in the inner casing and on which at least some of the guide blade rows are arranged; and wherein some of the guide blade rows are arranged on the blade ring, while the remaining guide blade rows are arranged on the inner casing.

2. The steam turbine as claimed in claim 1, wherein the first guide blade row of the steam turbine is arranged on the blade ring, and the last guide blade row of the steam turbine is arranged on the inner casing.

3. A steam turbine, comprising:

an outer casing;

an inner casing arranged in the outer casing;

a plurality of guide blade rows;

at least one blade ring arranged in the inner casing and on which at least some of the guide blade rows are arranged;

an extraction pressure space between a steam inlet and a steam outlet and connected to at least one extraction line via which extraction steam can be extracted from the steam turbine; and wherein the extraction pressure space communicates with an extraction gap arranged between two guide blade rows, the guide blade row connecting upstream to the extraction gap is the last guide blade row of the blade ring, and the guide blade row connecting downstream to the extraction gap is arranged on the inner casing.

4. A steam turbine, comprising:

an outer casing;

an inner casing arranged in the outer casing;

a plurality of guide blade rows;

at least one blade ring arranged in the inner casing and on which at least some of the guide blade rows are arranged; and wherein the blade ring is supported on the inner casing via at least one vertical support, the at least one vertical support having a carrier which projects radially from the blade ring and being supported on a carrying step of the inner casing, the carrier being formed on an external lateral flange of the blade ring and lying on the carrying step via a sliding plate.

5. The steam turbine as claimed in claim 4, wherein the blade ring comprises an upper blade ring half and a lower blade ring half, and the carrier is formed on the lower blade ring half.

6. The steam turbine as claimed in claim 5, wherein the inner casing comprises an upper inner casing half and a lower inner casing half, and the carrying step is formed on the lower inner casing half.

7. The steam turbine as claimed in claim 6, wherein the carrier is supported with respect to the carrying step on a guide step of the inner casing, the carrier bears against the guide step via the sliding plate, and the guide step is formed on the upper inner casing half.

8. The steam turbine as claimed in claim 7, wherein a contact zone, which is formed between the carrier and carrying step or between the carrier and sliding plate or between the sliding plate and carrying step or between the carrier and the guide step or between the carrier and sliding plate or between the guide step and sliding plate, extends rectilinearly in an axial direction.

9. A steam turbine, comprising:

an outer casing;

an inner casing arranged in the outer casing;

a plurality of guide blade rows;

at least one blade ring arranged in the inner casing and on which at least some of the guide blade rows are arranged;

wherein the blade ring is supported on the inner casing in a circumferential direction via at least one axial guide, the axial guide fixing the blade ring to the inner casing in the circumferential direction and allowing relative movements between the blade ring and inner casing in an axial direction and in radial direction, the axial guide comprising a guide body arranged on the inner casing and engaging an axial groove formed on the blade ring; and wherein the guide body is a separate component with respect to the inner casing and is inserted into a guide body holder formed on the inner casing.

10. The steam turbine as claimed in claim 9, wherein the inner casing comprises an upper inner casing half and a lower inner casing half, and the guide body is arranged on the lower inner casing half; and wherein the blade ring comprises an upper blade ring half and a lower blade ring half, and the axial groove is formed centrally on the lower blade ring half.

* * * * *